US005381886A

United States Patent [19]

Hay

[11] Patent Number: 5,381,886

[45] Date of Patent: Jan. 17, 1995

[54] APPARATUS AND METHOD WITH IMPROVED DRIVE FORCE CAPABILITY FOR TRANSPORTING AND METERING PARTICULATE MATERIAL

[76] Inventor: Andrew G. Hay, 17244 South Main Street, Gardena, Calif. 90248-3130

[21] Appl. No.: 115,177

[22] Filed: Aug. 31, 1993

Related U.S. Application Data

[63] Continuation-in-part of Ser. No. 76,314, Jun. 11, 1993.

[51] Int. Cl.[6] ..... B65G 31/04

[52] U.S. Cl. ..... 198/642; 406/99

[58] Field of Search ..... 198/617, 638, 639, 642, 198/723; 406/96, 99; 222/311, 312, 414

[56] References Cited

U.S. PATENT DOCUMENTS

| | | | |
|---|---|---|---|
| 1,489,571 | 4/1924 | Wright . | |
| 1,668,183 | 5/1928 | Albrecht . | |
| 2,081,182 | 5/1937 | Malke et al. . | |
| 2,712,412 | 7/1955 | West . | |
| 2,868,351 | 1/1959 | Hegmann . | |
| 3,592,394 | 7/1971 | Sinden | 239/669 |
| 3,643,516 | 2/1972 | Jacobson | 74/5 |
| 4,023,784 | 5/1977 | Wallace | 266/216 |
| 4,076,460 | 2/1978 | Roof | 417/236 |
| 4,516,674 | 5/1985 | Firth | 198/617 |
| 4,597,491 | 7/1986 | Conklin | 198/642 |
| 4,768,920 | 9/1988 | Gurth | 415/90 |
| 4,773,819 | 9/1988 | Gurth | 415/90 |
| 4,988,239 | 1/1991 | Firth | 406/99 |
| 5,051,041 | 9/1991 | Firth | 406/99 |

*Primary Examiner*—James R. Bidwell

*Attorney, Agent, or Firm*—Spensley Horn Jubas & Lubitz

[57] ABSTRACT

An apparatus for transporting and metering particulate material including a transport duct having an inlet, an outlet, and at least one moving surface located therebetween having a downstream facing drive surface. The apparatus further includes a motive device for moving the moving surface between the inlet and the outlet towards the outlet, wherein the particulate material becomes sufficiently compacted to cause the formation of a bridge composed of substantially interlocking particulates spanning the width of the transport duct. The bridging of the particulates causes the particulates to behave as a transient solid mass of particulates, such that the force exerted by the downstream facing drive surface upon particulates within the transport duct drives the entire mass of material through the transport duct towards the outlet. The apparatus is used to transport and meter particulate material under ambient conditions and against pressure.

36 Claims, 5 Drawing Sheets

APPARATUS AND METHOD WITH IMPROVED DRIVE FORCE CAPABILITY FOR TRANSPORTING AND METERING PARTICULATE MATERIAL

RELATED APPLICATIONS

This application is a continuation-in-part application of a co-pending application Ser. No. 08/076,314 filed Jun. 11, 1993.

BACKGROUND OF THE INVENTION

1. Field of the Invention

The present invention relates generally to apparatuses and methods for transporting and metering particulate material with improved drive force, and in particular embodiments, to such apparatuses and methods which can be used to both transport and meter solid material of a great range of sizes under both ambient conditions and against pressure.

2. Description of Related Art

A wide variety of equipment has been used to either transport or meter particulate material (such as, but not limited to, coal, other mined materials, dry food products, other dry goods handled in solid, particle form). Such transport equipment includes conveyor belts, rotary valves, lock hoppers, screw-type feeders, etc. Exemplary measurement or metering devices include weigh belts, volumetric hoppers and the like. In order to provide both transport and metering of particulate material, it was typically necessary to use or combine both types of devices into a system.

However, some of applicant's prior pump devices were provided with the capability of both transporting and metering particulate material. Examples of such prior designs include the rotary disk type pumps discussed in the following U.S. patents, each of which is assigned or licensed to the assignee of present invention and each of which is incorporated herein by reference: U.S. Pat. No. 4,516,674 (issued May 14, 1985); U.S. Pat. No. 4,988,239 (issued Jan. 29, 1991); and U.S. Pat. No. 5,051,041 (issued Sep. 24, 1991).

Large scale transport and/or metering of certain particulates, such as coal or friable food products, presents unique problems. A transport apparatus or system which is suitable for transporting one type of coal or other friable material may not be suitable for transporting a different type of coal or other friable material. For example, Kentucky coals maintain reasonable integrity when transported through conventional devices such as screw feeders and conveyor belts. However, Western United States coals tend to be more friable and may be degraded to a significant degree during normal transfer operations. It would be desirable to provide an apparatus which is capable of transferring all types of coal or other friable materials with a minimum amount of degradation.

A number of factors must be considered in the design of an efficient device for transporting or metering particulate materials. For example, the amount, size and type of particulate material to be transported must be taken into consideration. The distance over which the material is to be transported and variations in the surrounding pressure during transport must also be taken into account. The water content of the particulate solids is another factor which must be considered. It would be desirable to provide a pump device which is capable of transporting and metering a wide variety of particulate materials under both ambient and pressurized conditions.

The ability of an apparatus to apply drive force to a given type of particulate material is dependent upon a number of factors relating to the design and configuration of the apparatus. The design and configuration of some prior apparatuses makes them unsuited for certain applications requiring a relatively large amount of drive force and/or an efficient transfer of the drive force to the particulate material. For example, in certain applications, it may be necessary to transport a particulate material against a resistance, for example, vertically upward against gravity, up an incline, against a pressure head and/or over a relatively large distance. Therefore, it would be desirable to provide an apparatus and method for transporting and metering a wide variety of particulate materials with an improved ability to apply drive force to the particulate materials.

It is apparent from the above background that there is a present need for a solids handling or pumping device which operates as a single unit to provide simultaneous transport and metering of particulate material with improved drive force. The unit should be capable of transporting and metering a wide variety of particle types under a wide variety of conditions. Further, the unit should be structurally strong, and mechanically simple and durable so that it can be operated continuously over extended periods of time without failure.

SUMMARY OF THE DISCLOSURE

In accordance with embodiments of the present invention, an apparatus and method is provided for transporting and metering particulate materials with an improved drive force. The solids pump according to embodiments of the present invention is particularly suitable for transporting a wide range of particulate materials, including both small and large particulates and mixtures of them, having varying degrees of moisture content.

The present inventor has recognized that particulate material may be transported and metered through a transport duct defined by at least one moving drive surface provided that the particulates have bridged across the duct to provide, in effect, a compacted transient solid spanning the width of the duct. The present inventor has further recognized that particulate material which is bridged sufficiently to form, in effect, a transient solid spanning the width of a duct can be transported more efficiently against a resistance, such as gravity, fluid (gas or liquid) pressure or particle pressure, by providing the moving surface with at least one undulation providing a downstream facing surface for engaging the transient solid.

The present inventor has further recognized that the shape and relative dimensions of various components of the apparatus affect the amount of drive force generated by the apparatus and the efficiency by which the drive force is applied to the particulate material. In this regard, embodiments of the present invention relate to methods of manufacturing apparatuses (and the resulting apparatuses), which include the selection of appropriate dimensions and shapes for various components, based on the drive force requirements of the apparatus.

The solids pump according to a preferred embodiment of the present invention includes a transport duct having an inlet, an outlet, and a primary transport channel between the inlet and outlet. The primary transport channel is defined by at least one moving surface which moves between the inlet and the outlet towards the outlet. In a preferred embodiment, the transport duct and at least one moving surface is composed of a pair of coaxial, parallel rotary disks. (Further embodiments may employ nonparallel disks or moving surfaces arranged adjacent each other.) Opposed faces of the disks define a pair of moving surfaces or walls, between which the primary transport channel is located.

According to an embodiment of the invention, the moving surface (or surfaces) has (have) at least one discontinuity having a downstream facing surface. The discontinuity defines a transport facilitation zone. The transport facilitation zone is contiguous with the primary transport channel such that particulate material within the transport facilitation zone is contiguous with particulate material within said primary transport channel. Further embodiments employ a plurality of undulations or discontinuities, such as a plurality of evenly spaced radially extending discontinuities which define the transport facilitation zones. In further embodiments, the shape, length and width of the primary transport channel and/or the length of the moving surface measured along a cross-section of the channel are designed so as to achieve a desired drive force.

Preferably, the particulate material is compacted or compressed sufficiently to cause the formation of a transient solid or bridge composed of substantially interlocking particulates spanning the width of the primary transport channel and interlocking with moving drive surfaces. Movement of the drive walls from an inlet towards an outlet causes the particles of the particulate material to interlock with each other, with the outermost particles engaging and interlocked with undulations in the drive walls, such that drive force is transferred from the drive walls to the particles. Successive bridges occur cumulatively within the transport duct as further particulate material enters the inlet. This cumulative bridging may occur without the use of chokes or dynamic relative disk motion. However, further embodiments may include chokes or dynamic relative disk motion. Examples of such chokes and disk motions are described in U.S. Pat. No. 5,051,041; U.S. Pat. No. 4,988,239 and U.S. patent application Ser. No. 07/929,880 (each of which are assigned or licensed to the assignee of the present application and each of which are incorporated herein by reference).

The above discussed and many other features and attendant advantages of the present invention will become better understood by reference to the following detailed description when considered in conjunction with the accompanying drawings.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

In accordance with preferred embodiments of the present invention, apparatus and methods for transporting and metering particulate materials are provided with improvements relating to the ability to provide and efficiently transfer drive force, e.g., to pump against a resistance with increased efficiency and reliability. Embodiments may be used for transporting a wide range of particulate materials, including both small and large particulates and mixtures of them, having varying degrees of moisture content, under both ambient and pressurized conditions.

As a result of extensive research and development efforts focussed on improving the generation of and transfer of drive force to move particulate materials, the inventor has recognized that a number of factors contribute to a greater and more efficient generation and transfer of drive force. This has led to developments, described herein, by which any one or combination of these factors can be employed to improve the ability of a particulate materials pumping system to pump against a resistance (for example, vertically upward against gravity, up an incline, against a pressure head) and/or over a relatively large distance.

In accordance with preferred embodiments of the present invention, the apparatus described provides for transporting and metering particulate materials with increased efficiency and reliability. It may be used for transporting a wide range of particulate materials, including both small and large particulates and mixtures of them, having varying degrees of moisture content, under both ambient and pressurized conditions.

Figure 1:
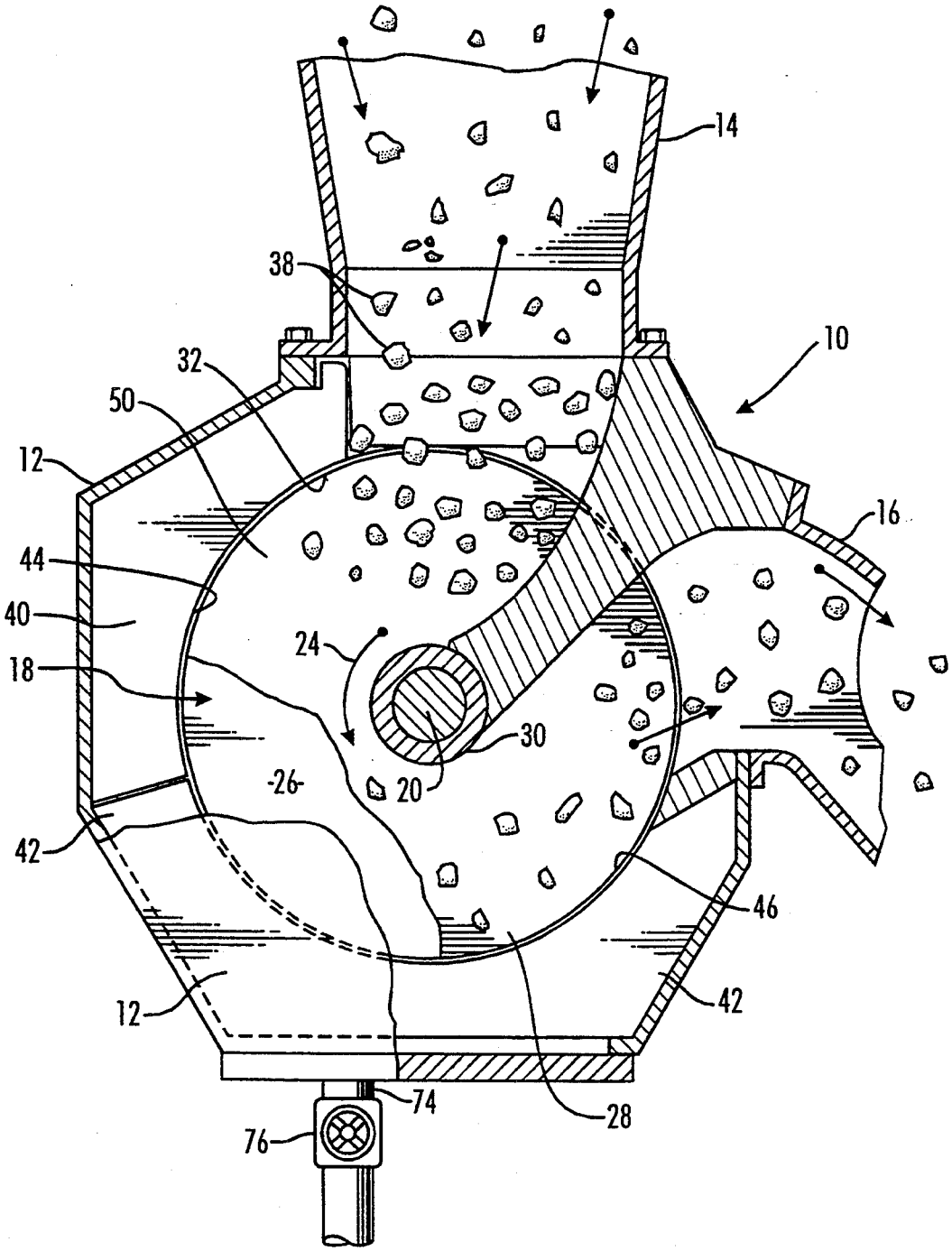
FIG. 1 is a partial sectional side view of a first preferred exemplary apparatus in accordance with an embodiment of the present invention.

A first preferred exemplary apparatus in accordance with an embodiment of the present invention is shown generally at 10 in FIG. 1. The apparatus 10 includes a housing 12, an inlet 14, and outlet 16. Various improvements in the inlet are described in the co-pending U.S. patent application titled "APPARATUS WITH IMPROVED INLET AND METHOD FOR TRANSPORTING AND METERING PARTICULATE MATERIAL", filed Aug. 31, 1993, (Ser. No. 08/115,173), which is assigned to the assignee of the present invention and which is incorporated herein by reference.

Located within housing 12 is drive rotor 18. The drive rotor 18 is mounted on shaft 20, with shaft 20 being rotatably mounted within a conventional low-friction bearing assembly (not shown) for rotation about the axis of shaft 20. The shaft 20 is connected to a hydrostatic or electrically-driven motor (not shown). The shaft 20 is driven by the motor in the direction shown by arrow 24 in FIG. 1.

Figure 2:
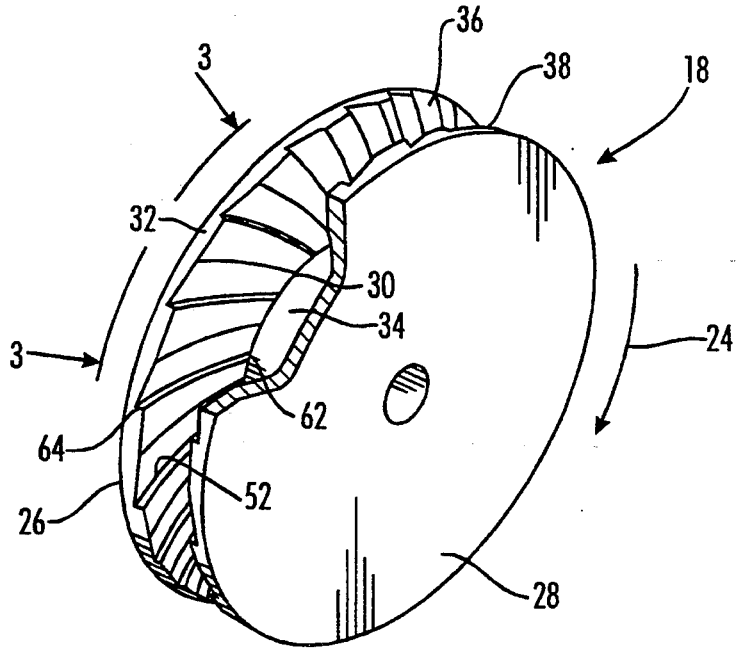
FIG. 2 is a perspective cut away view of the drive rotor of the preferred exemplary apparatus shown in FIG. 1 showing preferred exemplary discontinuities on opposing interior surfaces of parallel rotary disks.
Figure 3:
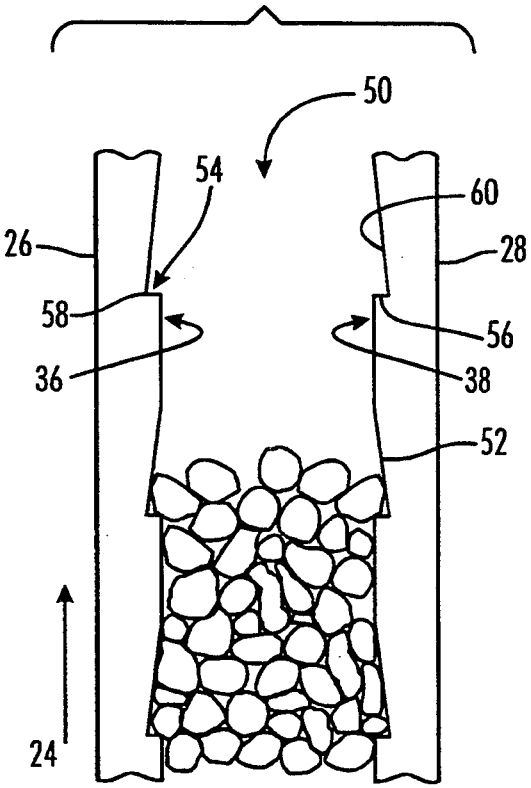
FIG. 3 is a partial sectional transverse view of the drive rotor shown in FIG. 2 taken in the 3—3 plane showing particulates bridged between opposing interior faces of the rotary disks.

As best shown in FIGS. 2 and 3, the drive rotor 18 includes rotary disks 26 and 28, having inner diameters 30 and outer diameters 32, and hub 34. Preferably, the drive rotor is made up of two separate rotary disks in order to facilitate assembly of the solids pump.

Rotary disks 26 and 28 include opposing interior faces 36 and 38. Opposing interior faces 36 and 38 are not planar but rather include a plurality of evenly spaced radially extending discontinuities 52. Each discontinuity 52 defines a transport facilitation zone 54 having a downstream facing drive surface 56, a bottom area 58 and an upstream facing surface 60.

As best shown in FIGS. 2 and 3, downstream facing drive surfaces 56 are perpendicular to interior faces 36 and 38 and backwardly curving such that trailing end 64 extends away from outlet 16 relative leading end 62 as rotary disk 26 moves between inlet 14 and outlet 16. This backwardly curving configuration facilitates discharge of particulates at outlet 16.

In the preferred embodiment shown in FIGS. 2 and 3, the width of transport facilitation zones 54 increase as transport facilitation zones 54 extend from inner diameter 30 to outer diameter 32. Upstream facing surfaces 60 of each rotary disk incline upwardly from bottom area 58 to the interior face of the rotary disk.

Opposing interior faces 36 and 38 are positioned opposite each other in order to provide surfaces between which the particulate solids are compacted. Preferably, the discontinuities 52 of opposing interior faces 36 and 38 are aligned to define a symmetric channel for transport of particulates as best shown in FIG. 3. This symmetric configuration mitigates against uneven loadings on the bearing assembly (not shown) supporting drive rotor 18 during compaction and transport of particulates.

The preferred exemplary apparatus 10 includes one or more exterior shoes such as those shown in FIG. 1 at 40 and 42. The exterior shoes 40 and 42 are designed to close the primary transport channel formed between interior faces 36 and 38 of the drive rotor 18. Each of the exterior shoes 40 and 42 includes a stationary inner wall 44 and 46, respectively. Inner walls 44 and 46, in combination with hub 34 and opposing interior faces 36 and 38, define the cross-sectional area of the primary transport channel 50 at any given point. Both exterior shoes 40 and 42 are mounted to the housing by way of suitable mounting brackets or pins. The inner wall, or inner walls in the case of plural shoes, are accurately formed so as to conform to the circular perimeter of the rotary disks 26 and 28. Therefore, as the rotary disks 26 and 28 rotate with the shaft 20, the stationary wall of the shoe keeps the particulate matter being transported between the opposing interior faces 36 and 38. In one preferred embodiment, the inner wall of the shoe extends axially (transversely of the shoe) beyond interior surfaces 36 and 38, respectively, of the drive rotor 18 so as to overlap the interior surfaces 36 and 38 of the drive rotor. The shoe is placed as close as possible, within acceptable tolerances, to the outer diameters 32 of interior faces 36 and 38. In this configuration, the shoe is not radially adjustable to move closer or further away from the hub 34 of the drive rotor 18 to change the cross-sectional area of the primary transport channel 50.

In an alternative embodiment, the shoe may be axially sized and shaped so as to fit between opposing interior faces 36 and 38 to form a curved outer wall for the primary transport channel 50. In this configuration, the radial location of the shoe may be adjusted toward or away from the hub 34 of the drive rotor 18 so as to change the cross-sectional area of the primary transport channel 50. For this purpose, a screw adjuster may be connected to one or a plurality of shoes as shown in U.S. Pat. No. 4,988,239 (incorporated herein by reference). The screw adjuster 50 shown there provides radially inward and outward adjustment of shoe 40 about a pivot pin 48. The inward and outward adjustment of shoe 40 allows setting up a choking or compaction of the solids as they move through the pump or, alternatively, to provide a diverging or a constant cross-sectional area along the duct. A second screw adjuster may be attached to a second shoe 42 shown in the '239 patent. The second screw adjuster is of the same type as the first and is provided to allow inward and outward radial adjustment of shoe 42. The inward and outward adjustment of shoe 42 would allow the size of the duct to be varied as the solids move through the pump after passing the first shoe 40 substantially independently of the angle of the second disk 26. In further embodiments, a single stationary wall may be provided, instead of the shoes 40 and 42 and shoe walls 44 and 46.

In one embodiment of the present invention (not shown), compaction of articulates is accomplished by providing means for positioning rotary disk 26 at an angle relative to rotary disk 28 such that the distance between the opposing interior faces 36 and 38 adjacent the inlet 14 is greater than the distance between opposing interior faces 36 and 38 between inlet 14 and outlet 16. (Alternatively, the disks may be angled relative to each other to define a diverging duct from the inlet to the outlet.) In this configuration, the cross-sectional area of the transport duct decreases (or increases, in the diverging embodiment) as the distance between the opposing interior faces decreases (or increases) thereby providing a convergence or choke (or divergence) in the transport duct. Preferably, means are also included to vary the angle at which the rotary disks rotates relative to each other. Variation of the angle modifies the rate of change of the cross-sectional area between the inlet and the outlet to provide a different convergence or choke (or divergence) in the duct. Various aspects of the foregoing and alternative preferred arrangements for accomplishing compaction are more fully described in U.S. patent application Ser. No. 07/929,880 which is incorporated herein by this reference.

In another preferred embodiment of the present invention (not shown), means for vibrating particulate material adjacent inlet 14 are provided to facilitate compaction and further facilitate the flow of particulate solids. In some applications, the use of vibrating means at inlet 14 may provide sufficient compaction and enhance or cause particle flow for pump operation. In other applications, the pressure head developed by gravitational forces exerted on particulates at inlet 14 may provide sufficient compaction for operation of the pump in which case no additional compaction would be necessary.

Figure 5:
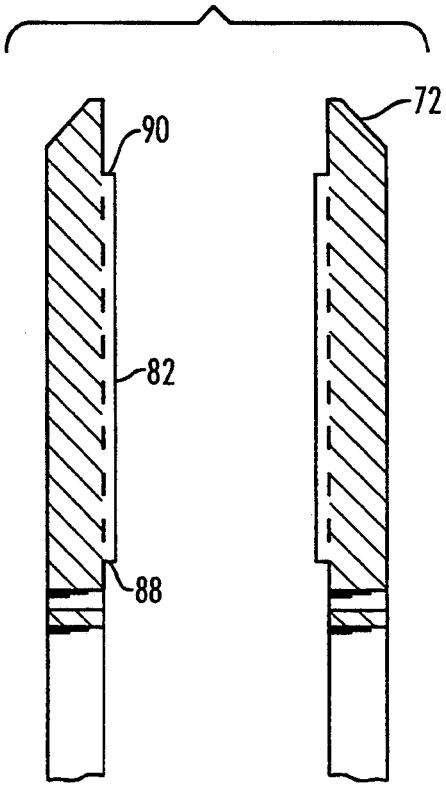
FIG. 5 is a partial sectional transverse view of the rotary disk shown in FIG. 4 taken in the 5—5 plane.

As best shown in FIG. 3, the compaction of particulate material results in the formation of a transient solid or bridge composed of substantially abutting or interlocking particulates spanning the width of primary transport channel 50 and interlocking with the undulations in the drive surfaces of the disks. The bridge of particulates is engaged by downstream facing drive surfaces 56 upon rotation of rotary disks 26 and 28 and transported towards outlet 16. In order to preclude particulates and particulate dust from wedging in the space defined between the housing 12 and the outer edge of each rotary disk 26 and 28, the rotary disks include a chamfer 72 as best shown in FIG. 5 which inclines away from housing 12 as the outer edge extends outward from the interior face of the rotary disk. Preferably, the outer edge is chamfered at an angle of about 45 degrees.

A dust drain 74 with an associated valve 76 is provided at the bottom of the housing for allowing removal of dust which may accumulate during pump operation. The valve 76 may be left open during pump operation to continually remove dust as it falls into the drain through an interior collection channel (not shown). Alternatively, the valve 76 may be left closed, and only opened when the interior collection channel has filled with dust. The opening and closing of the valve 76 will, of course, depend upon the dustiness or friability of the particular solid material being transported. The opening and closing of the valve 76 may be performed at the user's preference.

The size of the drive rotor 18 may vary widely, depending upon the type and volume of material which is to be transported or metered. Typically, outside diameters for the rotary disks 26 and 28 may range from a few inches to many feet. The smaller rotary disks are well suited for use in transporting and metering relatively small volumes of solid material such as food additives and pharmaceuticals. The larger size disks may be utilized for transporting and metering large amounts of both organic and inorganic solid materials, including food stuffs, coal, gravel and the like. The apparatus is equally well suited for transporting and metering large and small particles and mixtures of them, and large and small volumes, and may be used to transport and meter both wet and dry particulate material with the only limitation being that the material cannot be so wet that viscous forces dominate so as to disturb bridging.

Figure 4:
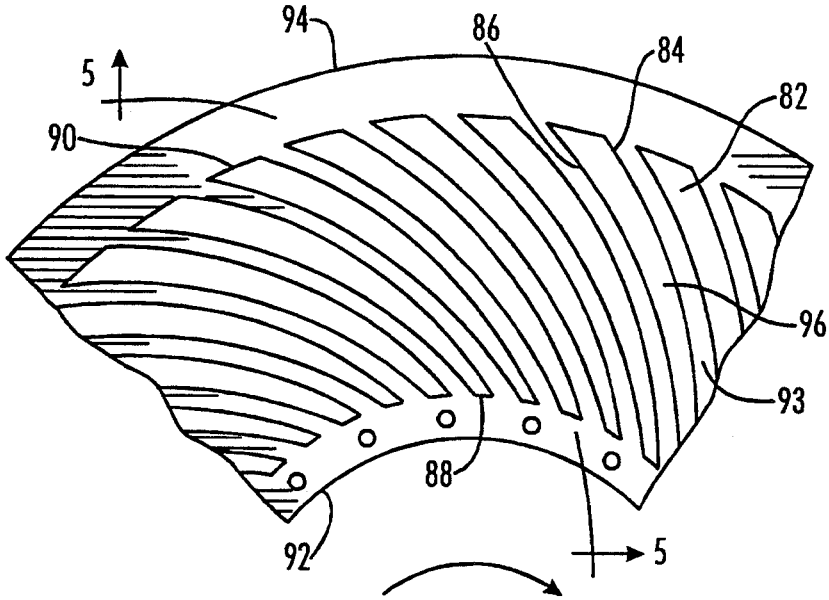
FIG. 4 is a plan view of a second preferred exemplary rotary disk.

The configuration of undulations or discontinuities on the opposed interior surfaces 36 and 38 may vary substantially in accordance with the present invention. In the preferred embodiment of rotary disks shown in FIGS. 4 and 5, the opposing interior faces 36 and 38 of each rotary disk include as discontinuities a plurality of evenly spaced radially extending upraised portions 82, each having a downstream facing drive surface 84 and an upstream facing surface 86 located toward the inlet from the downstream facing drive surface 84, each of which is substantially perpendicular to the interior face of the rotary disk. The upraised portions 82 also include an inner surface 88 and an outer surface 90, both of which are contiguous with a downstream facing drive surface 84 and an upstream facing surface 86 and which are substantially perpendicular to the interior face of the rotary disk. The inner surface 88 is positioned outward of the inner diameter 92 of the rotary disk and is substantially perpendicular to the radial component which intersects therewith. The outer surface 90 is positioned inward of the outer diameter 94 of the rotary disk and is substantially perpendicular to the radial component which intersects therewith. The upraised portion 82 also includes a top surface 96 which is substantially parallel to the interior face of the rotary disk. The width of each top surface 96 expands as the top surface 96 extends from near the inner diameter 92 to near the outer diameter 94 of the rotary disk such that the width of the recess 98 defined by adjacent upraised sections 82 remains constant as the recess 98 extends from near the inner diameter 92 to near the outer diameter 94. The upraised portion 82 is backwardly curving such that the outer surface 90 extends away from outlet 16 relative to inner surface 88 as the rotary disk moves between inlet 14 and outlet 16.

Alternatively, opposing interior faces may include radially extending undulations defining a wave-like series of alternating crests and troughs. Further embodiments may employ simple ridges or grooves in the disk walls.

The apparatus in accordance with embodiments of the present invention may be utilized for transporting particulate material against atmospheric pressure. In addition, the pump has been found useful in pumping solids into pressurized systems (e.g., wherein the pressure at the outlet side of the apparatus is greater than the pressure at the inlet side of the apparatus). Referring to FIGS. 1 and 2, it is preferred when pumping solids into pressurized systems that the entire cross-sectional area of outlet 16 be filled with solids during pumping. This forms a dam at the pump outlet which is a barrier to possible deleterious effects of reverse flow of gases, liquids or solids back into the pump through the outlet. The cumulative bridging of the particulates provides a sequentially formed cascaded reinforcement which adds strength to the particle bridge portions closer to the outlet, such that the bridge portions closer to the outlet will be strong enough to withstand the higher pressure at the outlet side of the apparatus. The duct length is preferably designed such that a sufficient amount of cumulative, cascaded bridging occurs in the duct to support and withstand the higher pressure at the outlet side of the pump. This can be accomplished with a convergent duct, constant cross-section duct or divergent duct system. Further improvements relating to the ability to pump against a pressure head are described in the co-pending U.S. patent application titled "IMPROVED APPARATUS AND METHOD FOR TRANSPORTING AND METERING PARTICULATE MATERIAL INTO FLUID PRESSURE", filed Aug. 31, 1993, (Ser. No. 08/116,229), which is assigned to the assignee of the present invention and which is incorporated herein by reference.

In the above-described preferred embodiments, the drive force of the drive rotor 18 is enhanced by providing discontinuities 52 on the opposing interior faces 36 and 38. The drive force of the apparatus may be defined as a pumping capability of the apparatus of driving the particulate solids through the primary transport channel 50 against a predetermined particulate pressure or any kind of predetermined resistances without causing slips of the particulate solids on the opposing interior faces 36 and 38. The resistances may be caused, for example, by gravity, pressurized fluid (gas or liquid) of a pressurized system which is coupled to the outlet 16 of the apparatus, or a combination of both.

Further embodiments employ one or a combination of a variety of other features which increase the drive or pumping forces of the apparatus. For example, the stationary inner wall 44 and 46 of each of the exterior shoes 40 and 42 may be coated with a low friction material, such as for example, polytetrafluoroethylene, and other ultra-high molecular weight materials, to reduce the friction between particulate solids and the stationary inner wall 44 and 46. As a result of the reduced friction, the drive force is increased. In another embodiment of the present invention, the material of which the interior surfaces 36 and 38 of the rotary disks 26 and 28 are made may be selected from those having an increased coefficient of friction to increase the drive force. In further embodiments, the friction between the drive surfaces 36, 38 and the particulate material may also depend on the smoothness or roughness of the surfaces. Thus, the drive force may be increased by increasing the roughness of the drive surfaces 36 and 38. Alternatively, the material of which the interior surfaces 36 and 38 are made may be selected from those having resilience to improve the ability of the particulates to interlock with the disk walls and to improve the efficiency with which the drive force is transferred to the particulates.

In still another embodiment of the present invention, the apparatus may be provided with a divergent outlet duct (not shown). Examples of such divergent outlet ducts are described in the above-referenced co-pending U.S. patent application titled "IMPROVED APPARATUS AND METHOD FOR TRANSPORTING AND METERING PARTICULATE MATERIAL INTO FLUID PRESSURE" (Ser. No. 08/116,229). Such a divergent outlet duct has a cross-section which increases in area toward an external opening of the outlet duct. The divergence of the outlet duct tends to reduce the pressure of compressed particulate material on the interior surfaces of the outlet duct toward the external opening thereof. As a result, the frictional resistance between particulate material and the interior surfaces is reduced through the outlet duct, resulting in an improved ability to drive the particulate material.

Furthermore, it has been recognized that the drive force generated by an apparatus is dependent upon the length of the primary transport channel 50 through which the solids move from the inlet 14 to the outlet 16. Typically, the longer the primary transport channel 50 relative to the channel width, the greater the drive force of the apparatus.

Figure 6A:
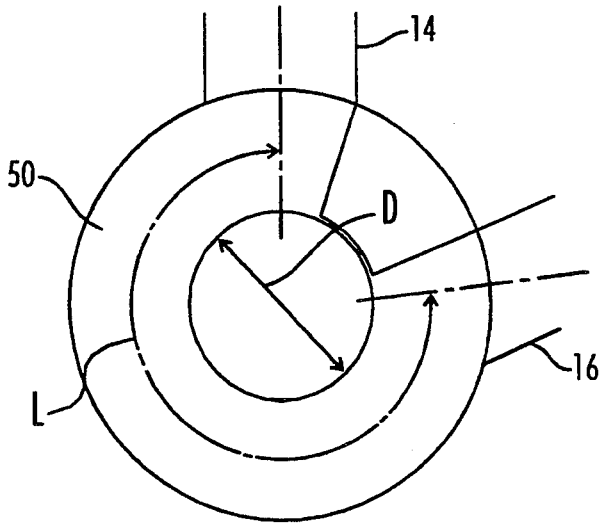
FIGS. 6(*a*) and 6(*b*) schematically illustrate dimensions of rotary disks and a primary transport channel.
Figure 6B:
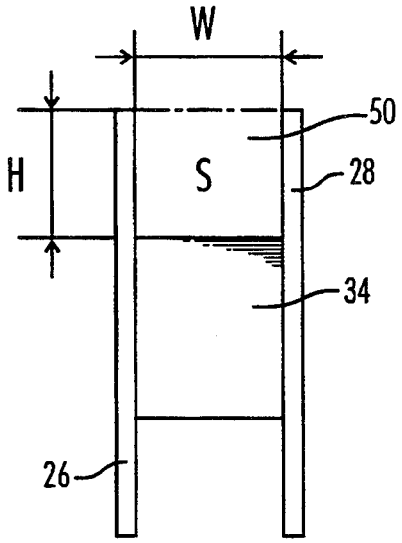

As shown in FIGS. 6(*a*) and 6(*b*), the primary transport channel 50 has a drive length L through which the particulate solids are moved by the rotation of the drive rotor 18 from the inlet 14 to the outlet 16. The primary transport channel 50 has a height H of the drive surfaces of the rotary disks 26 and 28, and a width W which is defined between the opposed faces 36 and 38 of the rotary disks 26 and 28. The hub 34 has a diameter D. The cross-section of the primary transport channel 50 may be of any suitable shape. In the illustrated embodiments, the cross-section shape of the channel 50 is generally rectangular and square. With a rotary disk apparatus, the drive length L is dependent upon the diameter D of the hub 36, such that an increase in the diameter D of the hub 34 results in an increase the drive length L of the primary transport channel 50. This results in an increase in the channel length L to channel width W ratio and, therefore, an increase in the particle drive force generated by the apparatus.

It has also been recognized that the drive force generated by an apparatus is further dependent upon the relative dimensions of the drive length L (which in rotary disk systems is dependent upon the hub diameter D), the height H and the width W of the primary transport channel 50. In particular, it has been found that the drive force is related to (and proportional to) the ratio of the drive length L (or diameter D) to the width W of a primary transport channel of square cross-section (e.g., H=W). That is, as the ratio of L (or D) to W increases, the drive force increases. It has also been found that, for other than square cross-section shaped channels 50 (e.g., H is not equal to W), the drive force is not only related to the ratio of L (or D) to W, but is also related to (and proportional to) H. That is, as H decreases, the drive force decreases.

Figure 7A:
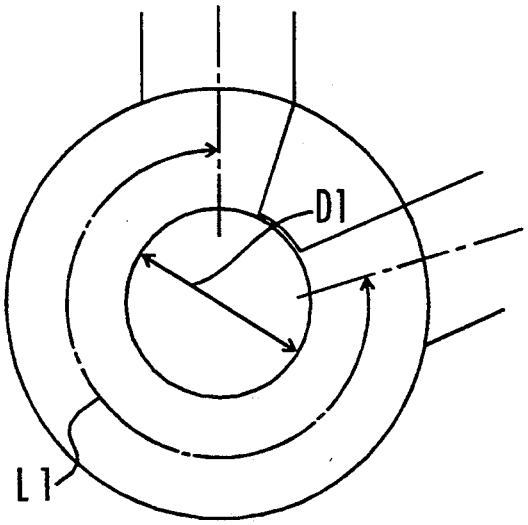
FIGS. 7(*a*) and 7(*b*) schematically illustrate rotary disks with hubs having different diameters.
Figure 7B:
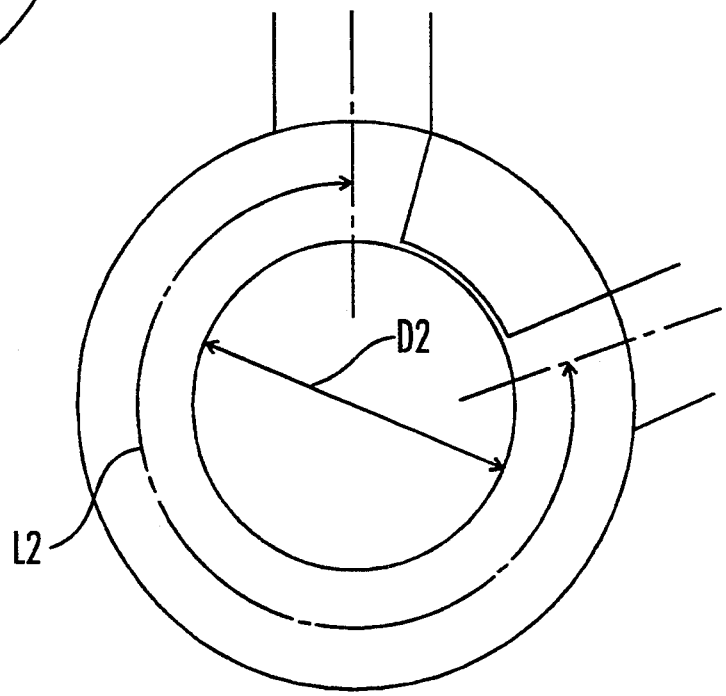

This feature is exemplified with reference to FIGS. 7(*a*) and 7(*b*). As shown in FIG. 7(*a*), the primary transport channel 50 has the height H and the width W which are equal (e.g., the shape of the cross-section of the channel is a square). The hub has the diameter D1 which define a drive length L1. In FIG. 7(*b*), the height H and the width W of the primary transport channel 50 are the same as in FIG. 7(*a*). In other words, the cross-section of the primary transport channel 50 is the same in FIGS. 7(*a*) and 7(*b*). However, the diameter of the hub in FIG. 7(*b*) is more than twice that of FIG. 7(*a*). The drive length of the primary transport channel 50 in FIG. 7(*b*) is L2, which is more than twice that of FIG. 7(*a*). Accordingly, the ratio of the diameter D of the hub to the width W of the primary transport channel for the FIG. 7(*a*) embodiment is D1/W, and for the FIG. 7(*b*) embodiment is D2/W, wherein D2/W is more than twice the value of D1/W. As a result, the apparatus of FIG. 7(*b*) can produce a substantially greater drive force (or a substantially greater pumping capability against a resistance) than the apparatus of FIG. 7(*a*).

Figure 8A:
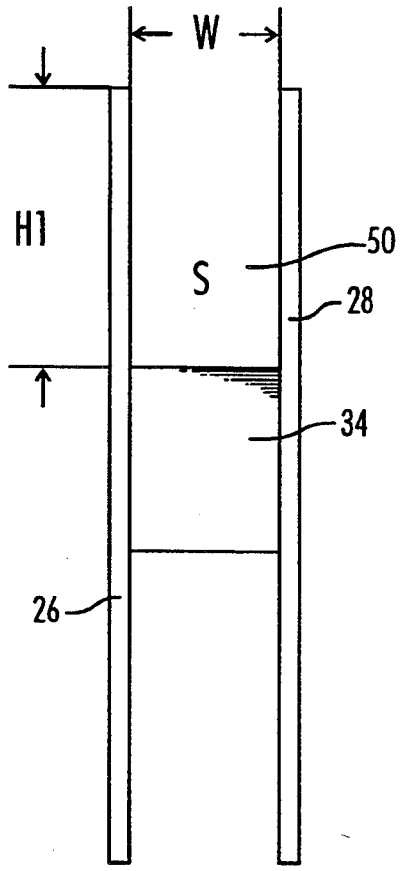
FIGS. 8(*a*) and 8(*b*) schematically illustrate rotary disks with different channel heights.
Figure 8B:
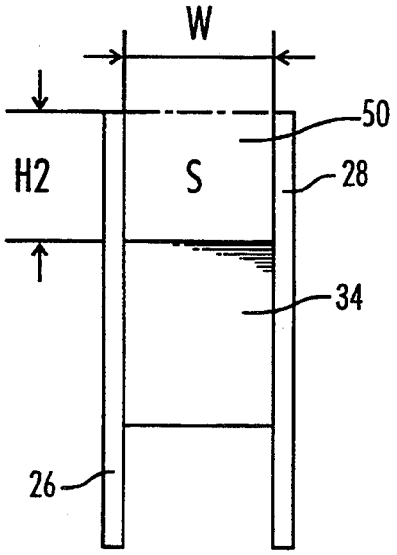

Furthermore, as shown in FIG. 8(*a*), the primary transport channel 50 has a width W which is equal to the width of the channel 50 in FIG. 8(*b*). The hub has the diameter D in FIG. 8(*a*) is also equal to the hub diameter D in FIG. 8(*b*). In FIG. 8(*a*), however, the height H1 of the drive surfaces defining the primary transport channel 50 are greater than the height H2 in FIG. 8(*b*). As a result, the apparatus of FIG. 8(*a*) can produce a greater drive force (or a greater pumping capability against a resistance) than the apparatus of FIG. 8(*b*).

Thus, from the forgoing, it can be seen that the magnitude of the drive force is dependent on at least one of the ratio of the drive length L to the width W (L/W), the ratio of the diameter D of the hub to the width W (D/W) and the ratio of the drive length L to the cross-section area S of the transport channel (L/S). More particularly, it is recognized that the greater the L/W ratio, or the D/W ratio, or the L/S ratio, the greater the drive force of the apparatus. In addition, the greater the height H, the greater the drive force of the apparatus. Therefore it is appreciated that the magnitude of the drive force F of an apparatus may be characterized as a function of each of the L/W ratio, the D/W ratio, the L/S ratio, and the height H, e.g., by the following formulae: F=f(L/W); F=f(D/W); F=f(L/S); or F=f(H).

It is often the case that the drive force F required for a particular application (e.g., pumping material up an incline or vertically upward, pumping against a pressure head and/or pumping over a predetermined distance) can be determined from various parameters of the application (e.g., the angle of incline, the magnitude of pressure and/or the length of the distance over which the pumped material is to travel). Therefore, according to embodiments of the invention, the values of any one or combination of L, D, W, S, and H are selected so as to provide a drive force F suitable for a particular application.

Preferably, the drive force value F of the apparatus is greater than a total pumping pressure P including a pressure of particulate solids, an external fluid (gas or liquid) pressure for cases wherein the apparatus is pumping into a pressurized system, and other resistances so that the apparatus effectively drives particulate materials without causing the particulate solids to slip on the faces 36 and 38 of the rotary disks 26 and 28. Accordingly, the following relations may be established: $F \geqq P$; or $f(L/W) \geqq P$; or $f(D/W) \geqq P$; $f(L/S) \geqq P$; or $f(H) \geqq P$. Therefore, according to embodiments of the invention, the values of any one or combination of L, D, W, S, and H are selected so as to provide a drive force F greater than P.

Although the preferred exemplary embodiments have been shown utilizing a single drive rotor, it is also possible to provide transport apparatus having multiple drive rotors which receive material from a single or multiple inlets. The use of multiple drive rotors provides for increased material through-put without having to increase the diameter of the rotor disk.

The bridging of solids results in a positive displacement of the solids. Accordingly, the pump may be used both as a transport and metering device. Due to the positive displacement of solids through the pump, metering is accomplished by measuring the rate of rotation of the drive rotor and calculating the amount of solids flow through the pump based upon the cross-sectional area of the duct at its narrowest point. When used as a metering pump, it is desirable that some type of conventional detection device be utilized to ensure that the passageway remains full of solids at all times during solids metering. Such conventional detection devices include gamma ray and electro-mechanical detectors. These detectors are all well known in the art and are neither shown in the drawings nor described in detail. The degree to which the particulate material are compacted will vary widely depending upon the materials being conveyed, pump rotation speed and whether or not the solids are being pumped against a pressure head.

The apparatus elements are preferably made of high strength steel or other suitable material. The interior surfaces of drive disks and the interior walls of the shoes are preferably made of an abrasion-resistant metal or other suitable material having non-adhesive qualities to facilitate discharge at the outlet during operation and to facilitate cleaning during maintenance. In suitable applications, the interior surfaces of the rotary disks and the interior wall of the shoes may be composed of a material such as polytetrafluoroethylene.

The apparatus according to embodiments of the present invention is also well suited for metering slugs or plugs of solid material into a flowing pipeline system or other system where discrete repetitive introduction of material is required. The accurate control of transport and metering which is achieved allows pulsed delivery of discrete amounts of particulate material into both pressurized and unpressurized systems.

Having thus described exemplary embodiments of the present invention, it should be understood by those skilled in the art that the above disclosures are exemplary only and that various other alternatives, adaptations and modifications may be made within the scope of the present invention. For example, although a drive rotor is a preferred form of a moving surface, it is not essential. Principles regarding the improvements to drive force described herein may be employed in other types of moving wall, conveyor belt or other system may be utilized so long as the bridging features are provided. Accordingly, the present invention is not limited to the specific embodiments as illustrated herein, but is only limited by the following claims.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A method of making an apparatus having a pair of rotary disk members spaced from each other by a distance W and connected to a hub of diameter D for imparting a drive force for driving a particulate material, the method comprising the steps of:

determining a total pump operating pressure P;

determining a drive force value F so that $F \geqq P$;

calculating at least one value for each of D and W from the relationship: $F=f(D/W)$;

forming said hub having a diameter D;

arranging the pair of rotatable disk members coaxially and spaced from each other by the distance W;

forming a peripheral wall adjacent the space between the pair of rotatable disk members so as to define a duct of width W in the space between the disk members and adjacent the peripheral wall; and forming a duct inlet and a duct outlet in material flow communication with the duct.

2. A pump made according to the method of claim 1.

3. A method according to claim 1, wherein the rotatable disk members define a pair of drive walls facing each other across the duct and wherein each drive wall defines a drive surface facing the space between the drive walls, said method further comprising the step of forming at least one downstream facing surface on the drive surface of at least one of the drive walls.

4. A pump for imparting a drive force F to drive a material against a total pump operating pressure P, the pump comprising:

a pair of spaced apart rotatable disk members;

a hub connected to the rotatable disk members, said hub having a diameter D, said disk members being arranged coaxially and spaced from each other by a distance W, such that $F=f(D/W)$, and $F \geqq P$;

a peripheral wall adjacent the space between the pair of disks and defining a duct of width W in the space between the disks;

a duct inlet in flow communication with the duct; and a duct outlet in flow communication with the duct.

5. A method of making an apparatus having first and second moveable drive wall members spaced from each other by a distance W and defining two walls of a duct therebetween of length L, for imparting a drive force for driving a particulate material through the duct, the method comprising the steps of:

determining a total pump operating pressure P;

determining a drive force value F so that $F \geqq P$;

calculating at least one value for each of L and W from the relationship: $F=f(L/W)$;

arranging the first and second moveable drive wall members adjacent and spaced from each other by the distance W;

forming a third wall adjacent the space between the first and second drive wall members so as to define the duct of width W and length L in the space between the drive wall members and adjacent the third wall; and forming a duct inlet and a duct outlet in material flow communication with the duct.

6. A pump made according to the method of claim 5.

7. A method according to claim 5, wherein each drive wall member defines a drive surface facing the space between the drive wall members, said method further comprising the step of forming at least one downstream facing surface on the drive surface of at least one of the drive wall members.

8. A method of making an apparatus having first and second moveable drive wall members spaced from each other by a distance W and defining two walls of a duct there between of cross-sectional area S and length L, for imparting a drive force for driving a particulate material through the duct, the method comprising the steps of:

determining a total pump operating pressure P;

determining a drive force value F so that $F \geqq P$;

calculating at least one value for each of L and S from the relationship: $F=f(L/S)$;

arranging the first and second moveable drive wall members adjacent and spaced from each other by the distance W;

forming a third wall adjacent the space between the first and second drive wall members so as to define the duct of cross-sectional area S and length L in the space between the drive wall members and adjacent the third wall; and forming a duct inlet and a duct outlet in material flow communication with the duct.

9. A pump made according to the method of claim 8.

10. A method according to claim 8, wherein each drive wall member defines a drive surface facing the space between the drive wall members, said method further comprising the step of forming at least one downstream facing surface on the drive surface of at least one of the drive wall members.

11. A method of making an apparatus having a duct of height H for imparting a drive force for driving a particulate material through the duct, the method comprising the steps of:

determining a total pump operating pressure P;

determining a drive force value F so that $F \geqq P$;

calculating at least one value for H from the relationship: $F=f(H)$;

arranging first and second moveable drive wall members adjacent and spaced from each other;

forming a third wall adjacent the space between the first and second drive wall members so as to define a duct in the space between at least a portion of each drive wall member and adjacent the third wall, wherein the portion of each drive wall member defining the duct has a height H; and forming a duct inlet and a duct outlet in material flow communication with the duct.

12. A pump made according to the method of claim 11.

13. A method according to claim 11, wherein each drive wall member defines a drive surface facing the space between the drive wall members, said method further comprising the step of forming at least one downstream facing surface on the drive surface of at least one of the drive wall members.

14. A method according to claim 11 further comprising the step of compacting particulate solids within said duct to form cumulative bridging of particulate solids in said duct.

15. A method according to claim 1, further comprising the step of forming a coating of low friction material on a surface of said peripheral wall facing said duct.

16. A method according to claim 1, wherein said step of forming a hub and a pair of rotatable disk members comprises forming said disk members with mutually facing surfaces having a relatively high coefficient of friction.

17. A method according to claim 1, further comprising the steps of forming an outlet duct having a diverging cross-sectional shape and coupling said outlet duct to said outlet, with the cross-sectional shape of said duct diverging away from said outlet.

18. A method according to claim 1, wherein said step of forming a hub and a pair of rotatable disk members comprises forming said disk members of a generally resilient material.

19. A method according to claim 8, further comprising the step of forming a coating of low friction material on a surface of said third wall facing said duct.

20. A method according to claim 8, wherein said step of arranging first and second moveable drive wall members comprises the step of forming said moveable drive wall members with mutually facing surfaces having a relatively high coefficient of friction.

21. A method according to claim 8, further comprising the steps of forming an outlet duct having a diverging cross-sectional shape and coupling said outlet duct to said outlet, with the cross-sectional shape of said duct diverging away from said outlet.

22. A method according to claim 8, wherein said step of arranging first and second moveable drive wall members comprises the step of forming said moveable drive wall members of a generally resilient material.

23. A method according to claim 11, further comprising the step of forming a coating of low friction material on a surface of said third wall facing said duct.

24. A method according to claim 11, wherein said step of arranging first and second moveable drive wall members comprises the step of forming said moveable drive wall members with mutually facing surfaces having a relatively high coefficient of friction.

25. A method according to claim 11, further comprising the steps of forming an outlet duct having a diverging cross-sectional shape and coupling said outlet duct to said outlet, with the cross-sectional shape of said duct diverging away from said outlet.

26. A method according to claim 11, wherein said step of arranging first and second moveable drive wall members comprises the step of forming said moveable drive wall members of a generally resilient material.

27. Apparatus for transporting a plurality of particles, said apparatus comprising:

a housing having a particle inlet for receiving a flow of said particles, and a particle outlet for expelling said particles;

at least one drive wall defining a duct between said inlet and said outlet and in particle flow communication with said inlet and said outlet, said at least one drive wall being movable relative to said housing from said inlet towards said outlet, for frictionally engaging particles within the duct and for imparting a drive force on the particles to move the particles within said duct toward said outlet, said at least one drive wall being formed of a material having a sufficient resiliency so as to improve the ability of said particles to interlock with said at least one drive wall.

28. Apparatus as recited in claim 27, wherein said at least one drive wall defines at least one downstream facing surface provided within said duct.

29. Apparatus as recited in claim 27, wherein said apparatus imparts a drive force F to drive the particles against a pressure P, and wherein said at least one drive wall comprises:

a pair of spaced apart rotatable disk members;

a hub connected to the rotatable disk members, said hub having a diameter D, said disk members being arranged coaxially and spaced from each other by a distance W, such that $F=f(D/W)$, and $F \geqq P$.

30. Apparatus as recited in claim 27, wherein said apparatus imparts a drive force F to drive the particles and wherein said at least one drive wall comprises:

a pair of drive walls spaced apart, wherein the space between said pair of drive walls defines said duct having a cross-sectional area S and a duct length L, and wherein $F=f(L/S)$.

31. Apparatus as recited in claim 27, further comprising an outlet duct coupled to said particle outlet of said housing and having a cross-sectional shape which diverges in the direction away from said particle outlet of said housing.

32. Apparatus as recited in claim 27, wherein said housing further comprises at least one stationary wall having a surface facing said duct, said duct facing surface being formed of a low friction material.

33. Apparatus as recited in claim 27, wherein said at least one drive wall comprises:

a pair of spaced apart drive walls defining said duct therebetween and being movable relative to said housing from said inlet towards said outlet for engaging particles within the duct so as to provide a bridge of said particles spanning from one drive wall to the other drive wall and to transfer drive force from said pair of drive walls to the particles within the duct;

wherein at least one drive wall of said pair of drive walls is formed of a resilient material to improve the efficiency with which the drive walls transfer drive force to the particles within the duct.

34. Apparatus as recited in claim 33, wherein said pair of spaced apart drive walls comprises a pair of rotatable disks.

35. Apparatus as recited in claim 27, wherein said at least one drive wall comprises a pair of spaced apart drive walls defining said duct therebetween and being movable relative to said housing from said inlet towards said outlet for engaging particles within the duct and forming a bridge of said particles spanning from one drive wall to the other drive wall, wherein each drive wall of said pair of drive walls is formed of a resilient material.

36. Apparatus as recited in claim 35, wherein said pair of spaced apart drive walls comprises a pair of rotatable disks.

* * * * *